US005143702A

United States Patent [19]

Der et al.

[11] Patent Number: 5,143,702

[45] Date of Patent: Sep. 1, 1992

[54] TWO STAGE WHITE LIQUOR OXIDATION APPARATUS

[75] Inventors: Bruce Der, Richmond, Canada; Bruce W. Beckstrom, Seattle; Elmer F. Guthrie, Bellevue, both of Wash.

[73] Assignee: A. H. Lundberg Associates, Inc., Bellevue, Wash.

[21] Appl. No.: 601,221

[22] Filed: Oct. 22, 1990

[51] Int. Cl.[5] ..... D21C 11/00

[52] U.S. Cl. ..... 422/185; 162/29; 162/30.11; 261/36.1; 261/123; 261/124

[58] Field of Search ..... 422/185, 236; 423/206, 423/207, 182, 183, 514, DIG. 3; 162/29, 30.1, 30.11, 31, 42, 239, 248; 261/36.1, 123, 124; 210/197, 928

[56] References Cited

U.S. PATENT DOCUMENTS 3,888,967 6/1975 Andersson et al. ..... 423/206
3,997,300 12/1976 Boatwright et al. ..... 422/185
4,053,352 10/1977 Hultman et al. ..... 162/29

*Primary Examiner*—Peter Kratz
*Attorney, Agent, or Firm*—Seed and Berry

[57] ABSTRACT

Apparatus (10) for the two stage oxidation of white liquor. The reaction vessel includes a central first stage chamber (24) and a second stage annular outer chamber (26). Heated air is first introduced through the outer second stage chamber (26) by pipes (36) and then directed through elements (38, 40, 44) to the central first stage chamber (24) for completion of the oxidation reaction. Unoxidized white liquor with a small amount of black liquor to catalyze the process is introduced to the first stage of the reaction vessel at a temperature in excess of 185 degrees F. Oxidized white liquor is removed from the second stage chamber and air is venter to atmosphere through the stack at the top of the first stage chamber. The second stage is preferably pressurized for greater efficiency.

8 Claims, 2 Drawing Sheets

TWO STAGE WHITE LIQUOR OXIDATION APPARATUS

TECHNICAL FIELD

The invention relates to the field of oxidation of regenerated liquors resulting from the manufacture of paper pulp, and more particularly does the invention relate to the oxidation of white liquors in reclaiming the sodium values therein.

BACKGROUND ART

The concept of using white liquor instead of pure sodium hydroxide in whole or in part in an alkali extraction step in cellulose bleaching is well known. In order to eliminate the risk of hydrogen sulfide formation when using white liquor in a bleaching step at a pH below 10 and to permit temperature control in the bleaching step, it has been suggested that the white liquor should be oxidized in equipment similar to a black liquor oxidation plant, that is to provide a long contact time between gas and liquid. However, and so far as is known, white liquor oxidation processes are not similar to the black liquor for a number of reasons.

The concept of white liquor oxidation is a natural development following the commercialization of oxygen delignification. The use of white liquor as an alkali source in oxygen bleaching requires that the sodium sulfide be oxidized prior to the delignification reactor. This is necessary since the oxygen atmosphere in the reactor causes the sodium sulfide to oxidize.

As those skilled in the art are aware, the oxidation of sodium sulfide is slow and requires a catalyst. In black liquor oxidation the reaction is catalyzed by the organics normally found in the liquor. Since these organics are not present in white liquor a small amount of black liquor is normally added to the incoming white liquor. Furthermore, the reaction rate of white liquor is much more dependent on the sulfide concentration, the oxygen concentration and the temperature.

Since pulp mills are shifting to oxygen bleaching to minimize dioxin content in the product and mill effluent, it is necessary to have a caustic source. But inasmuch as caustic soda is expensive it becomes feasible to reclaim the NaOH values from white liquor. However, white liquor contains sodium sulfide which reacts exothermically with the oxygen to initiate a reaction that is difficult to control.

Among the known prior art is a method of white liquor oxidation shown in U.S. Pat. No. 4,053,352 to Hultman. This patent discloses a system in which white liquor is oxidized with air at an elevated temperature to convert all sulfides to thiosulfates, thereby enabling the white liquor to be used in a number of steps including oxygen bleaching. No reactor of specific design is shown and in any event does not disclose a method such as is herein described and claimed.

In U.S. Pat. Nos. 3,928,351 and 3,997,300 to Boatwright, a two stage black liquor oxidation process is described in which air is introduced to inner and outer section of a reaction vessel through which black liquor is circulated. The reaction vessel is significantly different in structure from that of the instant invention.

U.S. Pat. No. 3,655,343 to Galeano shows a dual stage oxidation apparatus for black liquor having first and second oxidation chambers. The reaction chambers of this apparatus are connected to one another in series in which the spent liquor is first atomized and mixed with oxygen. The first oxidized liquor is then reoxidized and again mixed with molecular oxygen to complete the oxidation process. Again, this system is significantly different and does not pertain to white liquor. U.S. Pat. Nos. 4,239,589 to Elton; 4,255,848 to Sato; 3,654,070 to Pradt; and 3,362,868 to Backlund also teach systems and apparatus to oxidizing spent digestion liquors. However, none of these patents shows a method or reaction vessel structure which remotely similar to the system of this invention.

SUMMARY OF THE INVENTION

The invention is an oxidation method and apparatus for reducing the sulfidity of white liquor solution. The invention introduces the white liquor to a first stage oxidation step within the center of a reaction vessel against the flow of which is directed air exiting the second stage. The partially oxidized white liquor is then removed from the bottom of the vessel and recirculated to the top of an outer annular second stage in the vessel which is isolated from the first stage. Air is reacted with the liquor in the second stage and then removed as oxidized white liquor while air an excess gases from the reactor are vented to the first stage and from there to atmosphere.

Accordingly, it is among the many features of the invention to provide a white liquor oxidation method and apparatus which is more efficient than known systems since it oxidizes a higher percentage of the sodium sulfide content. The system is relatively simple and inexpensive but yet completely unique. The invention is reliable and dependable and significantly reduces the sulfidity of the white liquor. The system is easily maintained and controlled. Because of its two stage configuration the method and apparatus are more efficient in air usage and sulfide conversion rates and thus heat losses through the vent stack are reduced. The invention avoids the use of indirect heating of the liquor with associated scaling problems.

BEST MODE FOR CARRYING OUT THE INVENTION

Figure 1:
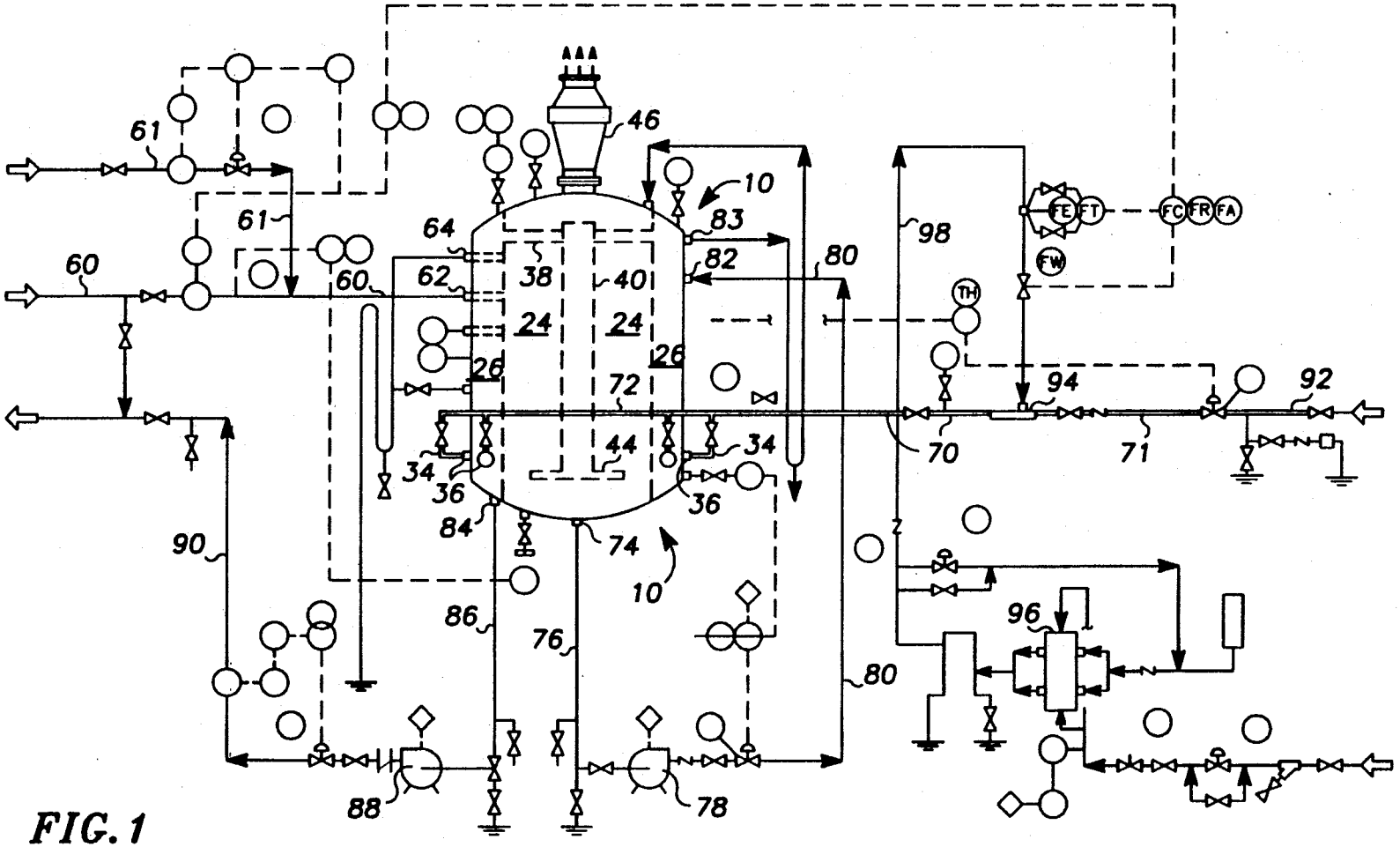
FIG. 1 is a diagram view of the method and apparatus of this invention including details of the reaction vessels.

Referring now to the drawings it will be seen that the reactor vessel of this method, generally designated by the number 10, is a vertical, generally cylindrical closed tank which in an installation will approximate twenty five feet in height and about nine feet in diameter. Tank 10 includes outer wall 12, upper end wall 14, and lower end wall 16. Within tank 10 and spaced concentrically inwardly from the outer wall 12 is a cylindrical bulkhead 22 extending from upper end wall 14 to lower end wall 16. Bulkhead 22 is fabricated to isolate the center or first stage chamber 24 from the outer or annular second stage chamber 26 defined by bulkhead 22. An inlet 62 directs incoming unoxidized white liquor; shown diagrammatically in dotted arrows, into the center first stage chamber 24 near the upper end thereof.

Flow of the white liquor is toward the bottom of the tank.

An air sparger assembly, generally designated by the number 30, includes an incoming air supply line 72 with connector lines 34 interconnecting air supply line 72 with a plurality of inlet conduits or pipes 36 which extend through the outer wall 12 into the annular second stage chamber 26. Air flows up the second stage chamber to a plurality of radial conduits 38 which extend generally horizontally inwardly to a central air column 40. The air column 40 is closed at its upper end as at 42 above the radial conduits 38 and extends downwardly to the bottom of the tank as shown.

At the lower end of column 40 is an air release and distributor spider 44 comprised of radial members 44 and a ring member 45 if desired. The distributor or spider releases sparging air through a multitude of holes which air flows upwardly through the first stage chamber 24 to the air vent or stack 46.

Figure 3:
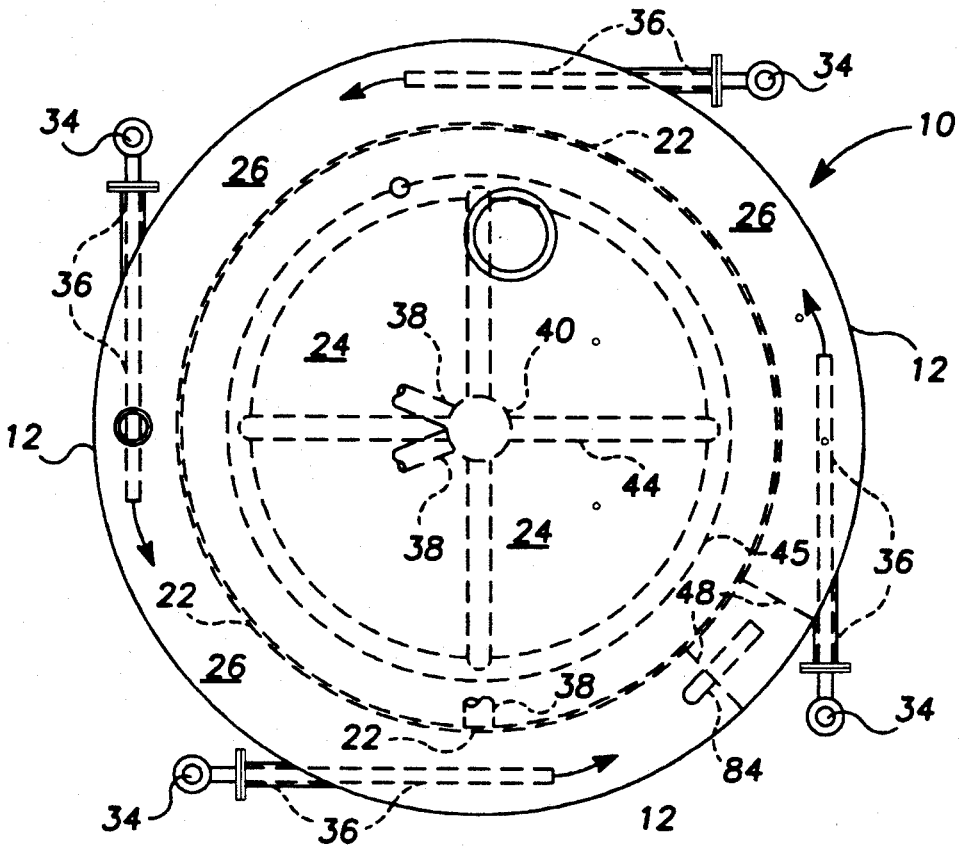
FIG. 3 is a top plan diagram view showing additional features of the reaction vessel.

The annular outer chamber 26 is provided with a compartmental partition wall 48 which may be single but is preferably double spaced as best shown in FIG. 3. Partition wall 48 extends from inner bulkhead wall 22 to outer wall 12 and from the top to the bottom end walls 14 and 16. Overflow lines 64 and 83 at the upper end of the vessel are provided for the central and outer chambers respectively.

Figure 2:
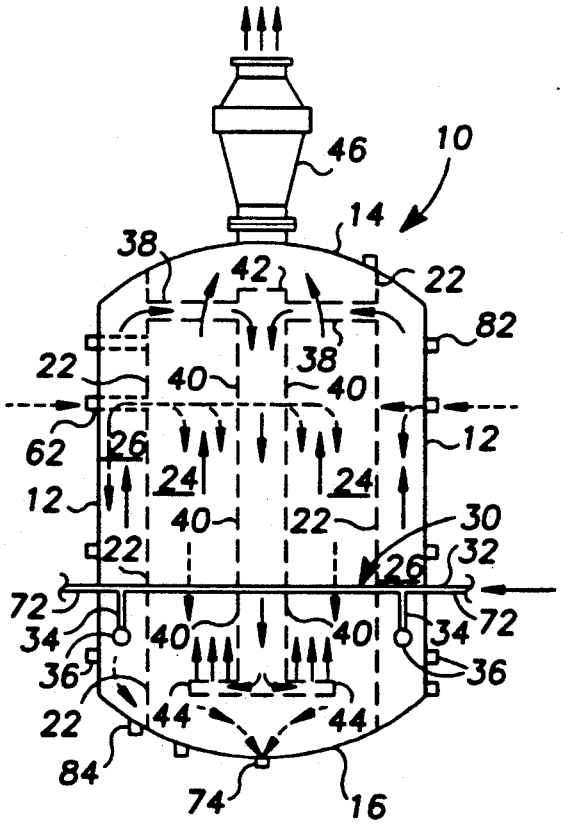
FIG. 2 is an elevational diagram of the reaction vessel showing more clearly details of its arrangement of parts.

Referring now to FIGS. 1 and 2 of the drawings to appreciate the process herein described, unoxidized white liquor flows through line 60 to inlet 62 in the reaction vessel. Inlet 62 extends through the annular outer chamber 26 into the central chamber 24. A predetermined small amount of unoxidized black liquor may be added to the incoming white liquor to provide necessary catalysts for the oxidation reaction. The white liquor flow, shown in dotted arrow lines, enters the central chamber near the top and flows generally downwardly as depicted by the arrows. At the same time air, shown in solid arrow lines, flows through line 70 to a ring type external manifold 72 and is directed into the reaction vessel through connector lines 34 to inlet pipes 36. A plurality of pipes 36 extend into the outer annular chamber so that a sufficient quantity of air is introduced into the reaction vessel for oxidation of the liquor.

The air flows (solid arrow lines) from inlet pipes 36 near the bottom, upwardly through outer chamber 26 to the radial connector lines 38 and thence to central air column 40. The air then continues downwardly through column 40 to the air distributor spider 44 and thence into central chamber 24. From there it continues upwardly through the liquor and is released to atmosphere via vent and stack 46. In this way the unoxidized white liquor entering central chamber 24 is subjected to a first stage oxidizing step by the counterflowing air.

The white liquor is then removed from central chamber 24, through bottom outlet 74 via line 76 and pump 78 to line 80 which reintroduces the liquor to the reactor vessel. Liquor enters outer annular chamber 26 through inlet 82 and is reacted with air rising from pipes 36. The liquor is then removed as substantially totally oxidized white liquor at the bottom of chamber 26 at outlet 84 via line 86. Accordingly, the white liquor upon entering the outer annular chamber 26 is subjected to a second stage oxidizing step by the counterflowing air. The oxidized white liquor is then transferred by pump 88 and line 90 for reuse as a source of alkali for cellulose pulp treatment.

The conversion rate of sulfide to thiosulfate is highly temperature dependent and it is estimated that the reaction rate doubles for every 10 to 15 degrees Centigrade rise in operating temperature. In this process the unoxidized incoming white liquor is and introduced at approximately 185 degrees Fahrenheit. Using air as the oxidation agent, however, requires a minimum amount of contact time between oxygen and liquor. This is assured by providing sufficient residence time in the reactor vessel, an excess of air and adequate contact surface. Sparging the air into the chambers as shown accomplishes adequate contact for the reaction.

It has been found that a disadvantage of the use of air is its cooling effect on the liquor due to evaporation. Though the oxidation of sulfide is exothermic, the amount of heat generated is insufficient to counteract the effects of evaporative cooling. Therefore, heat is provided by presaturating the air with direct steam from line 92 to air/steam mixer 94. Air is directed to the mixer 94 via compressor 96 and line 98 and steam air mixture is introduced in the temperature range of 195 to 200 degrees F. to avoid cold air contact with the liquor. The presaturated air after first passing through second stage reactor is re-used in the first stage where approximately 75% of the sodium sulfide conversion takes place. To optimize overall efficiency the two stage reactor is provided with plug or pressurized flow in its second stage.

We claim:

1. A reaction vessel apparatus for intimately contacting unoxidized white liquor with a quantity of oxidizing gas such as air, comprising:

a) a generally cylindrical tank having a generally vertically disposed cylindrical outer wall with a vertical longitudinal axis, said outer wall being closed at its upper and lower ends to define a closed reaction vessel, b) cylindrical bulkhead wall means concentrically disposed within said reaction vessel a predetermined distance from said outer wall and constructed to define a central chamber and an annular outer chamber which inner and outer chambers are sealed from each other, c) oxidizing air supply means for said reaction vessel including at least one inlet supply means connected and leading to said annular outer chamber, said air supply means also including air connector conduit means extending from said annular outer chamber to near the bottom of said central chamber and further including air venting means from said central chamber, d) first liquor inlet means extending from outside said reaction vessel through said annular outer chamber and said bulkhead wall into said central chamber where a first stage oxidation step takes place, e) first liquor outlet means in the lower portion of said central chamber including transfer conduit means for directing said liquor from said first liquor outlet means, f) second liquor inlet means connected to said transfer conduit means and also connected to and extending into said annular outer chamber wherein a second stage oxidation step of said liquor is achieved, and g) second liquor inlet means in the lower portion of said annular outer chamber of directing and transferring oxidized liquor from said reaction vessel.

2. The reaction vessel apparatus according to claim 1 and in which a vertical partition wall is disposed in said annular outer chamber from said upper to said lower end.

3. The reaction vessel apparatus according to claim 1 and wherein said air supply means further includes a central cylindrical air column of predetermined diameter within said central chamber which is closed at its top and which is operatively connected to said air connector conduit means for directing air toward the bottom of said central chamber.

4. The reaction vessel apparatus according to claim 1 and wherein said central air column also includes at its lower end an air distributor device for directing air radially outwardly from said air column.

5. The reaction vessel apparatus according to claim 1 and wherein each of said chambers is provided with overflow outlet means at a predetermined location near the upper end thereof.

6. The reaction vessel apparatus according to claim 2 and wherein said air supply means further includes a central cylindrical air column of predetermined diameter within said central chamber which is closed at its top and which is operatively connected to said air connector conduit means for directing air toward the bottom of said central chamber.

7. The reaction vessel apparatus according to claim 6 and wherein said central air column also includes at its lower end an air distributor device for directing air radially outwardly from said air column.

8. The reaction vessel apparatus according to claim 7 and wherein each of said chambers is provided with overflow outlet means at a predetermined location near the upper end thereof.

* * * * *

UNITED STATES PATENT AND TRADEMARK OFFICE

CERTIFICATE OF CORRECTION

PATENT NO. : 5,143,702

DATED : September 1, 1992

INVENTOR(S) : Bruce Der et al.

It is certified that error appears in the above-identified patent and that said Letters Patent is hereby corrected as shown below:

In column 4, claim 1, line 64, please delete "inlet" and substitute therefor -- outlet --.

Signed and Sealed this

Twenty-first Day of September, 1993

Bruce Lehman

*Attest:*

BRUCE LEHMAN

*Attesting Officer*

*Commissioner of Patents and Trademarks*